US005595310A

United States Patent [19]

Spamer et al.

[11] Patent Number: 5,595,310

[45] Date of Patent: Jan. 21, 1997

[54] DISPLAY DEVICE HAVING ARTICLE GUIDE MEANS FOR ENCOURAGING STOCK ROTATION

[75] Inventors: William S. Spamer, Roswell; J. Marshall Suttles, Elberton; Elizabeth T. Cooper, Atlanta, all of Ga.

[73] Assignee: The Mead Corporation, Dayton, Ohio

[21] Appl. No.: 518,741

[22] Filed: Mar. 3, 1995

Related U.S. Application Data

[63] Continuation-in-part of Ser. No. 330,415, Oct. 28, 1994, abandoned.

[51] Int. Cl.[6] ..... A47F 7/00

[52] U.S. Cl. ..... 211/59.2; 211/74; 312/45

[58] Field of Search ..... 211/59.2, 59.3, 211/74, 162, 94.5; 312/42, 45, 72

[56] References Cited

U.S. PATENT DOCUMENTS

| | | | |
|---|---|---|---|
| 2,581,363 | 1/1952 | Creedon | 211/134 |
| 2,678,735 | 5/1954 | Creedon | 211/151 X |
| 2,852,327 | 9/1958 | Mason | 312/45 |
| 3,501,016 | 3/1970 | Eaton | 211/74 X |
| 3,805,964 | 4/1974 | Titus | 211/59.2 |
| 3,983,822 | 10/1976 | Suttles | 108/108 |
| 4,228,905 | 10/1980 | Cammarota | 211/71 |
| 4,239,099 | 12/1980 | Williams et al. | 193/32 |
| 4,314,648 | 2/1982 | Spamer | 211/59.2 |
| 4,318,485 | 3/1982 | Clement | 211/59.2 |
| 4,367,818 | 1/1983 | Suttles | 211/59.2 |
| 4,401,221 | 8/1983 | Suttles | 211/59.2 |
| 4,496,037 | 1/1985 | Spamer | 193/2 R |
| 4,706,820 | 11/1987 | Spamer et al. | 211/59.2 |
| 5,022,535 | 6/1991 | Spamer | 211/59.2 |
| 5,050,748 | 9/1991 | Taub | 211/59.2 |

*Primary Examiner*—Robert W. Gibson, Jr.
*Attorney, Agent, or Firm*—Tsugihiko Suzuki

[57] ABSTRACT

A display device has an article dispenser having front and rear opposite edges and designed to support articles. The dispenser includes a plurality of parallel tracks extending from the front edge of the dispenser toward the rear edge. Each track receives a row of articles for movement along that track. The dispenser also includes a diverting pathway extending substantially transversely of the tracks. The pathway interconnects the rear ends of the tracks and receives articles for movement therealong so that articles are allowed to be transferred from the pathway to each track and vice versa. The dispenser further includes a guide member disposed adjacent to the rear end of one of the tracks. When the articles in the track associated with the guide member are moved backwards along that track, they are brought into contact one after another with the front surface of the guide member and guided laterally along the front surface into the pathway.

30 Claims, 14 Drawing Sheets

DISPLAY DEVICE HAVING ARTICLE GUIDE MEANS FOR ENCOURAGING STOCK ROTATION

This application is a continuation in part of U.S. patent application Ser. No. 08/330,415, filed Oct. 28, 1994, abandoned.

BACKGROUND OF THE INVENTION

This invention relates to an article display device useful in dispensing articles such as bottled, canned or packaged food or drink products, and more particularly to an improvement of such a display device for encouraging stock rotation. The device of the invention facilitates placement of new products to the rear of the device and is thus convenient particularly when used with those products which are time sensitive to identification changes, date coding (e.g., product expiration date) and the like.

Display shelf devices have been used in the merchandising of a number of products. These devices slidably support on their shelves articles in rows and gravity feed them one after another to the fronts of the shelves as the leading articles in each row are removed successively from the shelves. Conventional display shelf devices are disclosed, for example, in U.S. Pat. Nos. 4,239,099; 4,314,648; and 4,496,037 which are owned by the assignee of the present invention.

While such conventional shelf devices have experienced considerable success, they are not without disadvantages. To encourage stock rotation on the shelves, i.e., to prevent the same products from sitting on the shelves for a long period of time, it is desired that the shelves are back loaded upon product replenishment so that newer products are placed behind older products. This makes the older products easier to access than the newer products, which allows the products on the shelves to be purchased in the sequence of their dates of manufacture. However, because it is difficult to back load the conventional shelves, it is common that such shelves are replenished with products from their fronts. As a result, older products are pushed far back into the positions behind newer products. This leads the servicing personnel of stores into the situation in which they have to manually gather older products often to move them to the fronts of the shelves so that the older products become more accessible for customers to purchase within the recommended term for sale or use.

Similar problems exist with respect to suspension type bottle dispensing devices wherein bottles are suspended by their neck flanges. Conventional suspension type devices are disclosed, for example, in U.S. Pat. Nos. 4,318,485; 4,367,818; and 4,401,221 which are owned by the assignee of the present invention.

What is needed, therefore, is an improved display device which encourages stock rotation. Such a display device should facilitate at the time of product replenishment placement of newer products at the positions behind older products which have been displayed on the device.

SUMMARY OF THE INVENTION

In meeting the foregoing needs, the present invention provides a display device including an article dispenser which has front and rear opposite edges and which is adapted to support articles. The dispenser includes a plurality of parallel tracks extending from the front edge of the dispenser toward the rear edge. Each track receives a row of articles for movement along that track. The dispenser also includes a diverting pathway extending substantially transversely of the tracks. The pathway interconnects the rear ends of the tracks and receives articles for movement therealong so that articles are allowed to be transferred from the pathway to each track and vice versa. The dispenser further includes guide means disposed adjacent to the rear end of at least one of the tracks. The guide means has a front surface such that when the articles in the associated track are moved backwards along that track, they are brought into contact one after another with the front surface and are guided laterally of the track along the front surface into the pathway.

According to the invention, the track(s) associated with the guide means can be used as an inlet or loading port for articles upon replenishment. More particularly, articles are loaded into the inlet track from the front end of such a track and are then pushed backward of the track against the guide means. This causes the articles to be guided into the diverting pathway and move across the rear of the dispenser to be diverted into the other track or tracks which are either empty or partially filled with older articles. When the newly loaded articles are moved into the other track(s), they are placed behind the older articles. Therefore, the older articles are maintained at the front of the dispenser even after the dispenser is replenished with the newer articles.

Transfer of articles from the pathway to the other track(s) may be achieved by the gravity. To utilize the gravity for this purpose, the display device in a preferred embodiment is provided with support means for supporting the dispenser in a tilted fashion so that the dispenser is inclined downwardly toward its front edge. This arrangement not only allows articles in the pathway to gravity feed into the tracks but also allows the articles in each track to gravity feed one after another to the front edge of the dispenser as the leading articles in that track successively are removed from the track. Consequently, articles once received in the pathway cascade down into the empty or partially filled tracks which are intercommunicated with the inlet track(s) through the pathway.

According to a preferred embodiment of the invention, the dispenser is a shelf unit on which articles are placed to be displayed. The shelf unit includes a floor for slidably supporting articles at their bottoms and a plurality of spaced parallel partition walls upstanding from the floor and extending along the tracks. Each track is defined by the floor and a pair of adjacent partition walls. The intermediate partition walls, i.e., the partition walls other than the end partition walls, extend from the front edge of the shelf unit toward the rear edge thereof and terminate in their respective rear ends which are located at positions remote from the rear edge of the shelf unit. It is preferred that the distance between the rear edge of the shelf unit and the rear ends of the intermediate partition walls is no less than the transverse size of each article loaded into the tracks. For example, when the shelf is loaded with bottles, the aforementioned distance is no less than the diameter of the bottles.

According to a preferred embodiment of the invention, the guide means is located between the rear end of the inlet track and the rear edge of the shelf unit. In this case, the diverting pathway extends between the guide means and one of the opposite side edges of the shelf unit. The floor of the pathway is continuous with and disposed in the plane of the floor of the tracks. The guide means may be formed separately from the shelf unit and mechanically, physically or chemically secured to the unit. Alternatively, the guide means may be formed integrally with the shelf unit.

The guide means extends vertically from the floor of the pathway so that the front surface of the guide means is disposed to define about a right angle with respect to the floor. As viewed from the top, the front surface of the guide means may extend rearward from the rear end of the inlet track and curve toward the one side edge of the shelf unit so that it is concave toward the pathway. Alternatively, such a front surface may be flat and disposed, as viewed from the top, in angular relationship with the length of the tracks.

When the number of the tracks intercommunicated by the pathway is two, transfer of articles from the pathway to the other track may be achieved by the guide means without relying upon the gravity. Such guide means has a guide surface extending rearward from the rear end of the inlet track and curving toward one of the side edges of the dispenser and then forward to the rear end of the other track. By this means, the pathway has an arched outer perimeter defined by the guide surface. Accordingly, when articles are moved backwards along the inlet track, they are guided along the guide surface into the other track through the pathway.

The two-track device described above may be used in a horizontal condition wherein articles are transferred to the other track solely by the guide means. Alternatively, it may be used in a tilted condition wherein articles are transferred by the guide means in cooperation with the gravity.

The dispenser of the two-track device may be a shelf unit on which articles are placed to be displayed. In such an embodiment, the shelf unit includes a floor for slidably supporting articles at their bottoms and three spaced parallel partition walls upstanding from the floor. Each track is defined by the floor and a pair of adjacent partition walls. The medial partition wall extends from the front edge of the shelf unit toward the rear edge and terminates in its rear end which is located at a position remote from the rear edge of the shelf unit. The pathway is defined between the arched guide surface and the rear end of the medial partition wall.

Alternatively, the dispenser of the two-track device may be a bottle suspension unit for supporting flanged bottles such that the bottles are suspended by their neck flanges. In such an embodiment, the suspension unit includes two pairs of substantially parallel track rails extending along the tracks. Each pair of rails define the respective track between themselves. The rails of each pair are spaced apart to receive between them the necks of bottles such that the bottles are slidably engaged at their neck flanges with the rails of that pair. The pathway is defined by a pair of inner and outer arcuate rails spaced apart to receive between them the necks of bottles such that the bottles are slidably engaged at their neck flanges with the arcuate rails. The guide surface in this embodiment is provided by the outer arcuate rail.

The present invention also provides a gravity feed display shelf comprising a shelf unit and support means. The support means supports the shelf unit in a tilted condition wherein the unit is inclined downwardly toward its front edge. The shelf unit includes a plurality of parallel tracks extending from the front edge of the unit toward the rear edge. Each track is designed to receive a row of articles for movement along that track. As a result, when articles are received in each track, they are allowed to gravity feed one after another to the front edge of the unit as the leading articles in the respective track successively are removed from the track. The shelf unit also includes a diverting pathway extending transversely along the rear edge of the unit. The pathway is designed to receive articles for movement therealong and interconnects the rear ends of the tracks in such a manner that articles are allowed to be transferred from the pathway to any one of the tracks and vice versa. Such an arrangement allows articles to gravity feed from the pathway into the tracks once the articles are received in the pathway. The shelf unit further includes guide means disposed adjacent to the rear end of at least one of the tracks. The guide means has a front surface such that when the articles in the associated track are forcibly moved backwards along that track, they are brought into contact one after another with the front surface and are guided laterally of the track along the front surface into the pathway to subsequently gravity feed into at least one of the other tracks.

The present invention further provides a shelf unit for placement onto an inclined support frame to assemble the above-described gravity feed display shelf.

The objects and advantages of the present invention will be apparent from the following description, the accompanying drawings and the appended claims.

DETAILED DESCRIPTION OF THE PREFERRED EMBODIMENTS

Figure 1:
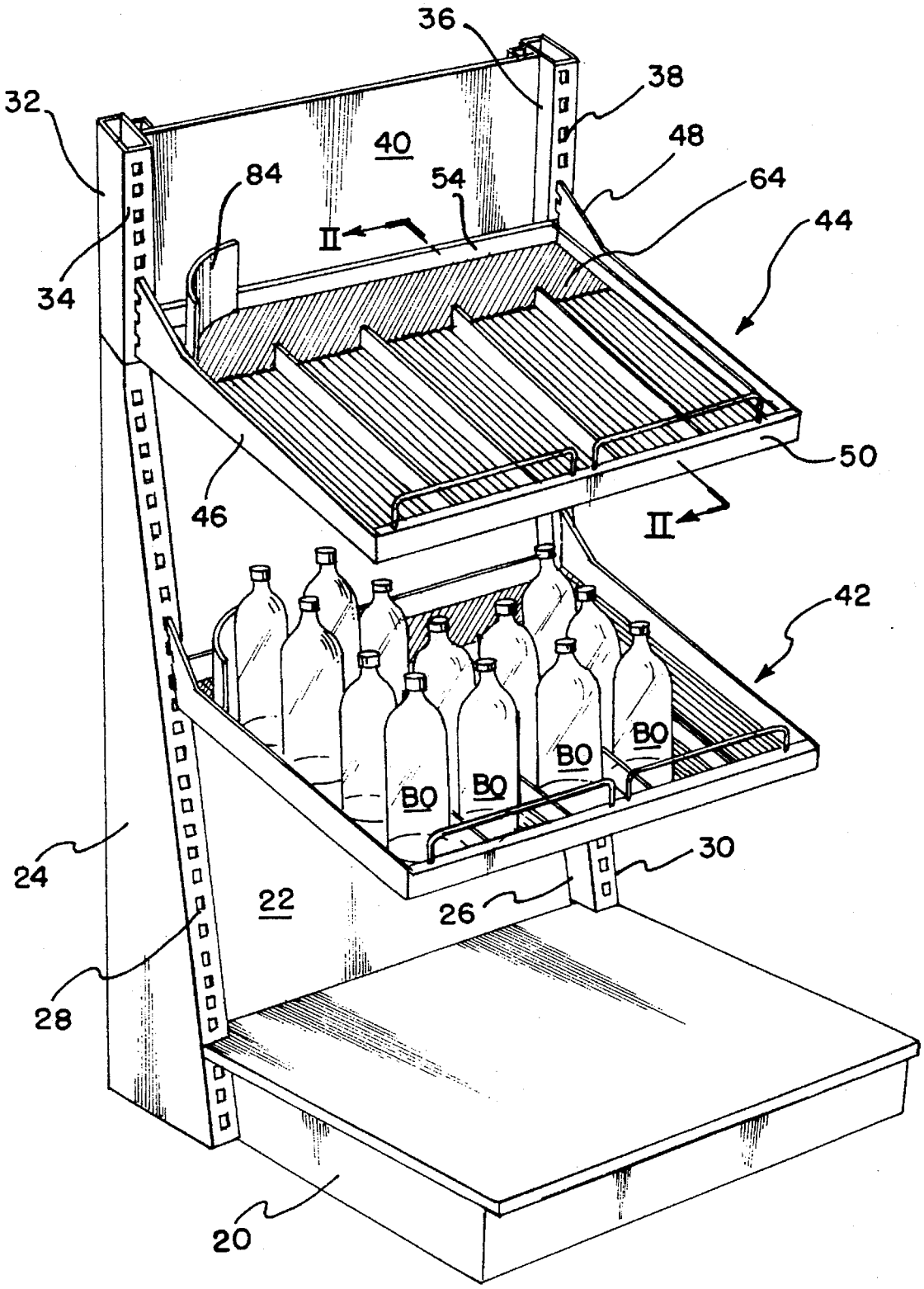
FIG. 1 is a perspective view of a display stand having gravity feed display shelf devices constructed in accordance with the present invention.

FIG. 1 shows a gravity feed display stand designed to display and merchandise bottled beverages such as soft drinks contained in PET bottles. The display stand comprises a base 20 and a lower back panel 22 extending upwardly from the base 20. The back panel 22 is supported by lower post members 24 and 26 having slotted sloping faces 28 and 30, respectively. Secured atop the lower post member 24 is an upper post member 32 having a vertically disposed slotted face 34. Similarly, an upper post member 36 is mounted atop the lower post member 26 and is provided with a slotted vertical face 38. An upper back panel 40 is supported by the upper post members 32 and 36. Shelves or shelf devices generally indicated at 42 and 44 are mounted respectively on the slotted sloping faces 28 and 30 and on the slotted vertical faces 34 and 38.

The shelves 42 and 44 are substantially identical and are supported in substantially parallel relationship to each other on the respective sloping and vertical faces 28, 30, 34 and 38. Engaging tabs on the shelves 42 and 44 cooperate with the slots in the sloping and vertical faces in different way to detachably connect the shelves to the post members 24, 26, 32 and 36. Thus the shelves 42 and 44 are maintained in parallel relationship by virtue of the fact that the tabs and the angle of the sloping faces of the lower post members 24 and 26 cooperate in such manner as to achieve this result. The manner in which this is accomplished is described in U.S. Pat. No. 3,983,822 issued Oct. 5, 1976, which is hereby incorporated by reference.

Figure 2:
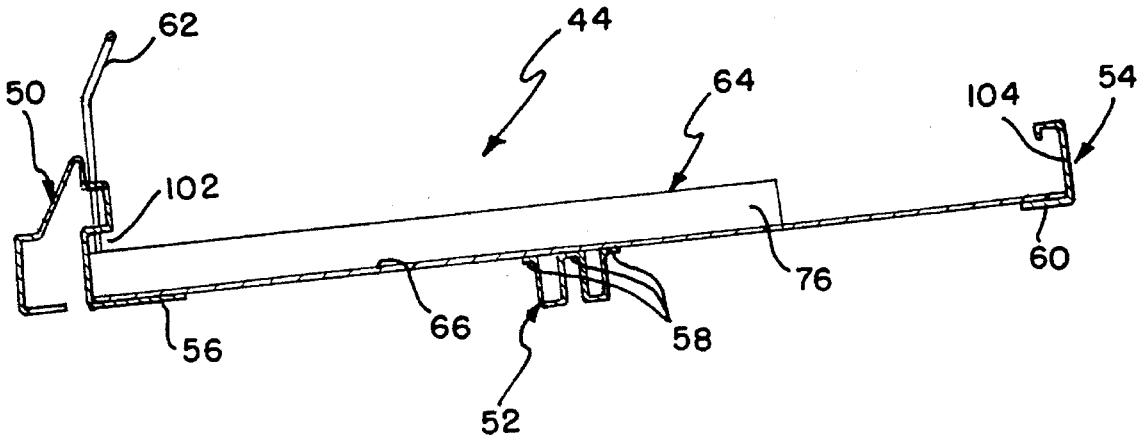
FIG. 2 is a view taken along the line II—II in FIG. 1.

As shown in the drawings, each of the shelves such as 42 and 44 comprises support means in the form of a substantially rigid support frame and a shelf unit 64 located on the support frame to accommodate and support a number of bottles. As is best shown in FIGS. 1 and 2, each support frame includes a pair of spaced parallel side elements 46 and 48 extending forward from the respective post members and a set of spaced parallel front, intermediate and rear elements 50, 52 and 54 interconnecting the side elements 46 and 48. The side elements 46 and 48 are provided at their respective rear ends with the aforementioned engaging tabs. The elements 50, 52 and 54 include upwardly facing support surfaces 56, 58 and 60, respectively, all disposed in a common plane which is forwardly and downwardly tilted. These surfaces in cooperation support the shelf unit 64 in a tilted fashion. The angle of tilt from the horizontal may vary somewhat but experience has shown that this angle preferably should be between about 3.5 degrees and about 8 degrees. The angle of tilt in most applications of the invention may be approximately 6 degrees from horizontal.

The front element 50 of the support frame includes stop means in the form of a wire guard 62 which is slotted into the front element 50. This wire guard 62 is a portion on which foremost/lowermost bottles on the shelf unit 64 rest, as will be described in more detail.

Figure 3:
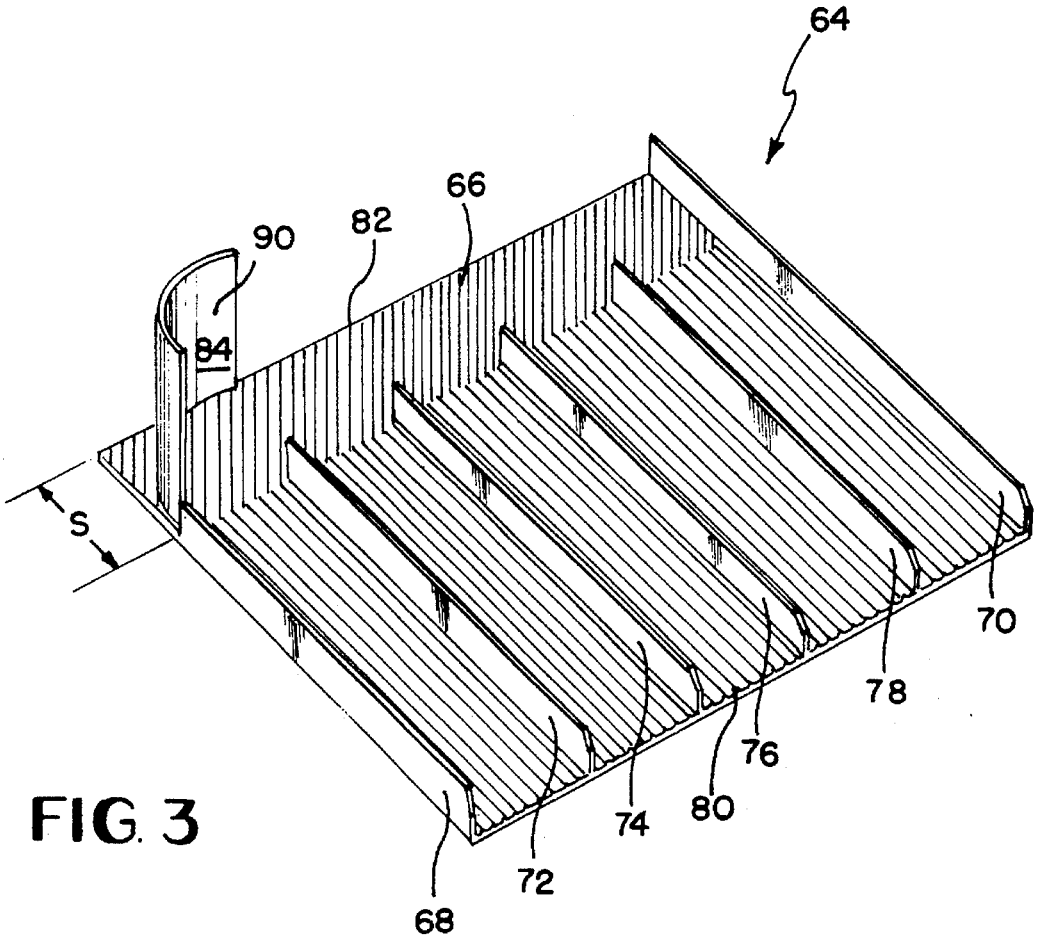
FIG. 3 is a perspective view of a shelf unit in FIG. 1.

FIG. 3 illustrates the shelf unit 64 in the form separated from the support frame. As illustrated, the shelf unit 64 includes a base panel 66 and a pair of end partition walls 68 and 70 extending along the opposite side edges of the base panel 66. The partition wall 68 extends backwards from the front edge 80 of the base panel 66 and terminates at a position remote from the rear edge 82 of the panel 66 whereas the partition wall 70 extends entirely along the respective side edge. The unit 64 also includes a series of equally spaced parallel intermediate partition walls 72, 74, 76 and 78, which are also parallel to the end partition walls 68 and 70. Similarly to the partition wall 68, these intermediate partition walls extend backwards from the front edge of the panel 66 and terminate at the intermediate points between the front and rear edges of the panel 66. The length of these intermediate partition walls is generally equal to the length of the end partition wall 68.

The intermediate partition walls divide the space between the end partition walls 68 and 70 into a plurality of tracks extending from the front edge 80 toward the rear edge 82. In other words, each track is defined by the respective pair of adjacent partition walls and the floor which is provided by the upper surface of the base panel 66. The partition walls 68, 70, 72, 74, 76 and 78 act as guides for bottles on the shelf unit 64 and cause the bottles placed on the shelf unit 64 to be arranged in parallel rows as shown in FIG. 1, each row of bottles being received in the respective track. In order to minimize friction between the floor of each track and the bottles to be supported thereon, a plurality of upwardly projecting parallel ribs 86 (see FIG. 4) are integrally formed with the track floor along each track. Each rib 86 is of a generally triangular cross section.

As mentioned above, the partition walls 68, 72, 74, 76 and 78 only partially extend along the length of the base panel 66. This leaves an undivided area between the rear edge 82 and the rear ends of the partition walls 68, 72, 74, 76 and 78. The distance "S" (see FIG. 3) between the rear edge 82 and the partition walls 68, 72, 74, 76 and 78 is no less than the diameter of bottles to be placed on the shelf unit and preferably no more than 1.5 times the diameter of such bottles.

Figure 4:
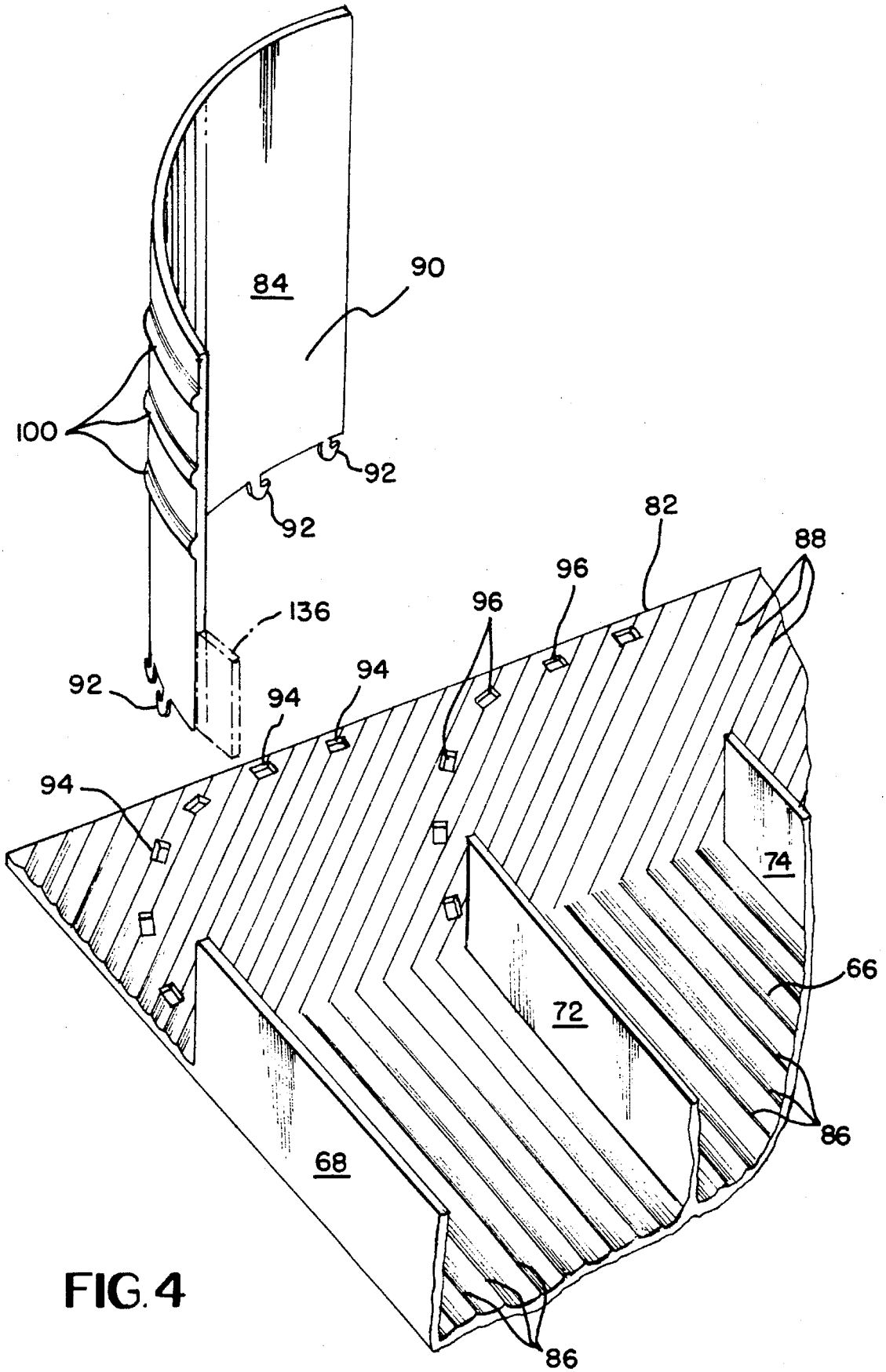
FIG. 4 is a fragmentary, enlarged and exploded perspective view of the shelf unit in FIG. 3.

Referring further to FIG. 3, the shelf unit 64 further includes a curved guide member 84 mounted on the base panel 66 in the undivided area at adjacent to the rear end of the end track defined between the partition walls 68 and 72. This guide member 84 and the rear end portion of the end partition wall 70 in cooperation define therebetween a diverting pathway which extends along the rear edge 82 of the panel 66. The rear ends of all the tracks are open to the pathway so that all the tracks are intercommunicated through the pathway to allow bottles to be transferred from the pathway to any one of the tracks and vice versa. When the unit 64 is placed on the support frame, the rear element 54 of the support frame acts as a guardrail for bottles in the diverting pathway and prevents the bottles from falling off of the unit 64 from the rear edge 82. The pathway floor is also defined by the upper surface of the panel 66 and is also formed integrally with a plurality of upwardly projecting parallel ribs 88 as best shown in FIG. 4. These ribs 88 are disposed obliquely of the base panel 66 so that the ribs 88 define an obtuse angle with respect to the ribs 86 on the track floors. The ribs 88 are also of a generally triangular cross section.

The front/inside surface 90 of the guide member 84 is configured to assume a part of a cylindrical surface so as to serve as a guide surface for contacting and guiding bottles on the shelf unit 64. More particularly, the front surface 90 defines about a right angle with respect to the base panel 66 and, as viewed in FIG. 6, it is curved concavely to the pathway or to the corner of the base panel 66 defined between the front edge 80 and the end partition panel 70. As shown in FIG. 3, one of the vertical edges of the guide member 84 is located adjacent to the rear end of the end partition wall 68 so that the front surface 90 of the member 84 is continuous smoothly with the inside surface of the wall 68.

The above-described guide member 84 may be formed separately from the base panel 66 and may be connected to the base wall 66 by any conventional fastening means including mechanical locks, adhesives and ultrasonic welding. However, for the purpose of providing a relocatable guide means, mechanical locks are preferred. FIG. 4 shows a guide member 84 which is secured to the base panel 66 by means of a mechanical lock such as arrow-headed locking tabs 92. These locking tabs 92 are formed integrally with the guide member 84 and are disposed along the lower edge of the guide member 84 at equal spacings so that they can be detachably engaged with a set of locking apertures 94 formed in the base panel 66. These locking apertures 94 are disposed at equal spacings along an imaginary arcuate line having a curvature equal to that of the lower edge of the guide member 84. A similar set of locking apertures such as a set of apertures 96 may be formed in the base plate 66 at a location near the rear end of each track except for the end track defined between the walls 78 and 70. These sets of locking apertures allow the guide member 84 to relocate to different positions behind the tracks other than behind the end track between the walls 78 and 70 so that any intermediate track can be used as an inlet track as is described later. Reference numeral 100 in FIG. 4 denotes ribs formed on the guide member 84 to increase the structural rigidity of the member 84.

Figure 5:
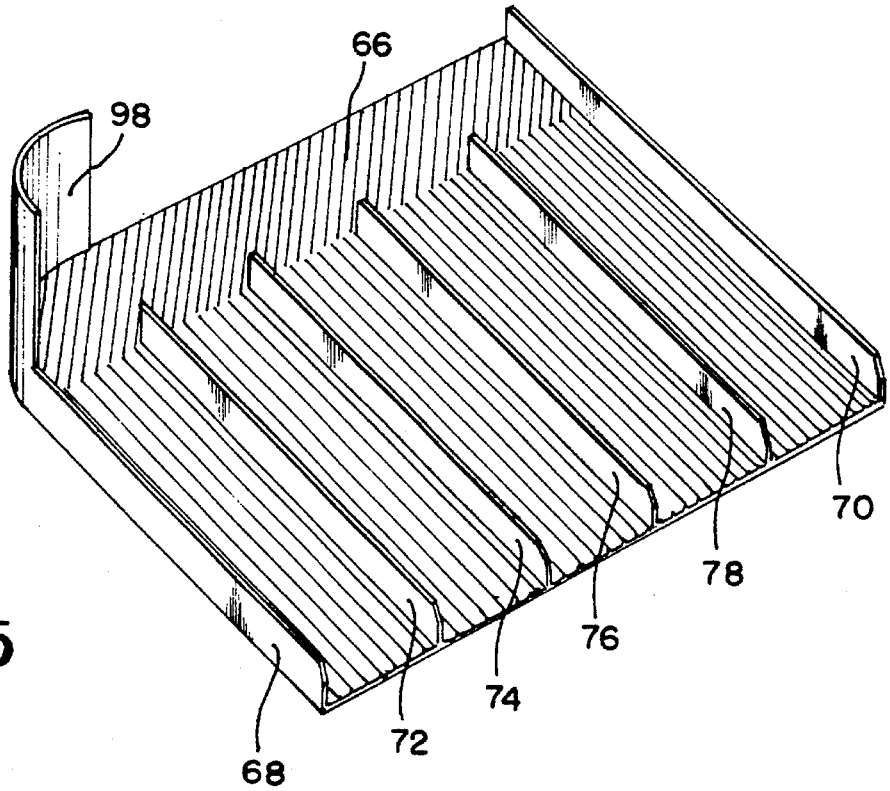
FIG. 5 is a perspective view of a modified form of the shelf unit in, FIG. 3.

Alternatively, the guide member may be formed integrally with the base panel 66. Such an integral guide member is shown in FIG. 5 at reference numeral 98.

The above shelf unit may be formed from any low friction material; however, the unit is preferably formed of a plastic material such as polyvinyl chloride, polystyrene and the like. Among these plastic materials, the most preferred material for manufacturing the shelf unit is high impact polystyrene. Such polystyrene may have silicone or some other suitable lubricant material dispersed therein in order to reduce friction between the ribs 86 and 88 and the bottles to be disposed thereon.

In order to locate the shelf unit 64 in position on the support frame, it is necessary to simply insert the front and rear edges 80 and 82 of the unit 64 into the channel shaped recesses 102 and 104 (see FIG. 2) provided by the front and rear elements 50 and 54, respectively. Of course, if required, the unit 64 may be secured to the support surfaces 56, 58 and 60 by suitable fastening means such as described for the guide member 84.

The shelf unit 64 thus located on the support frame is tilted downwardly toward the front edge of the unit 64. Therefore, when bottles are loaded onto the shelf such as 42 as shown in FIG. 1, there is a natural tendency for rows of bottles automatically to slide downwardly and forwardly so that the leading/lowermost bottles such as B0 have their sliding movement arrested by the wire stop 62 and normally rest against the front element 50. Also, as the leading bottles are removed from each track, the remaining bottles are allowed to be gravity fed one after another to the front edge 82 so as to be easy to access and ready to be dispensed.

Figure 6:
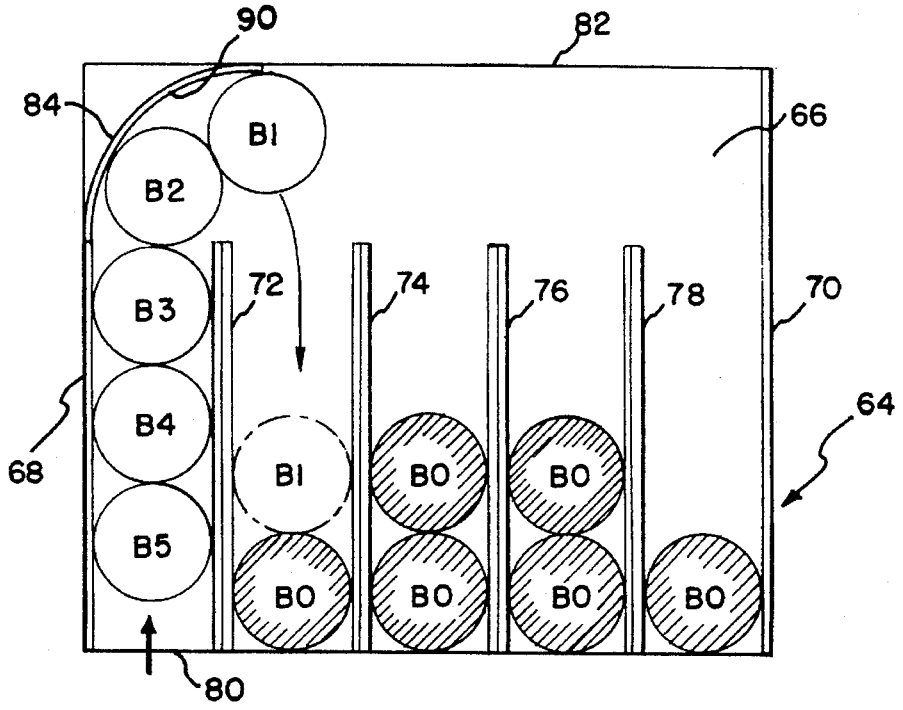
FIGS. 6 and 7 are schematic plan views of the shelf unit in FIG. 3.
Figure 7:
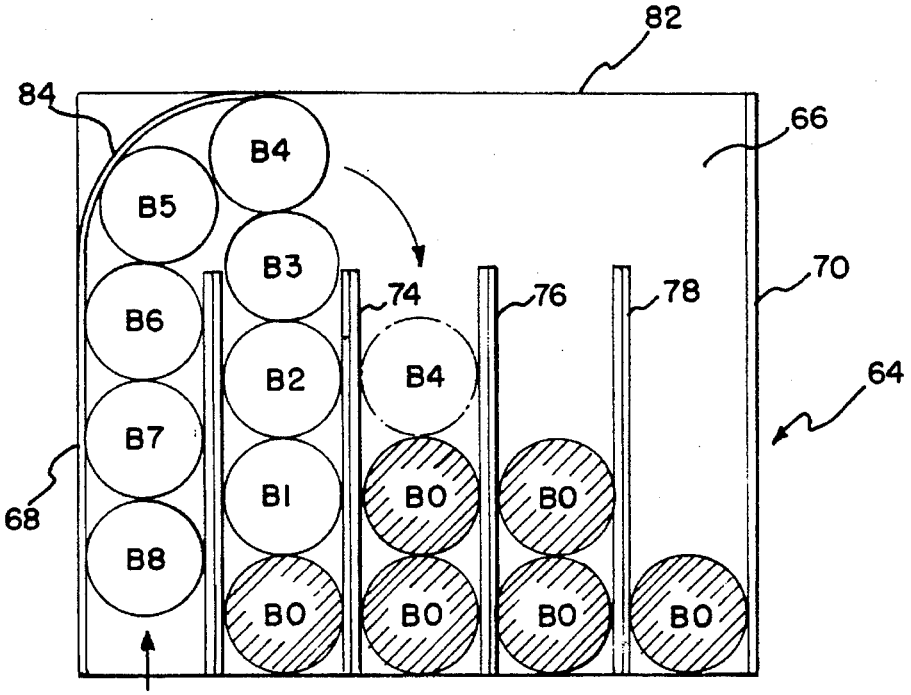
Figure 8:
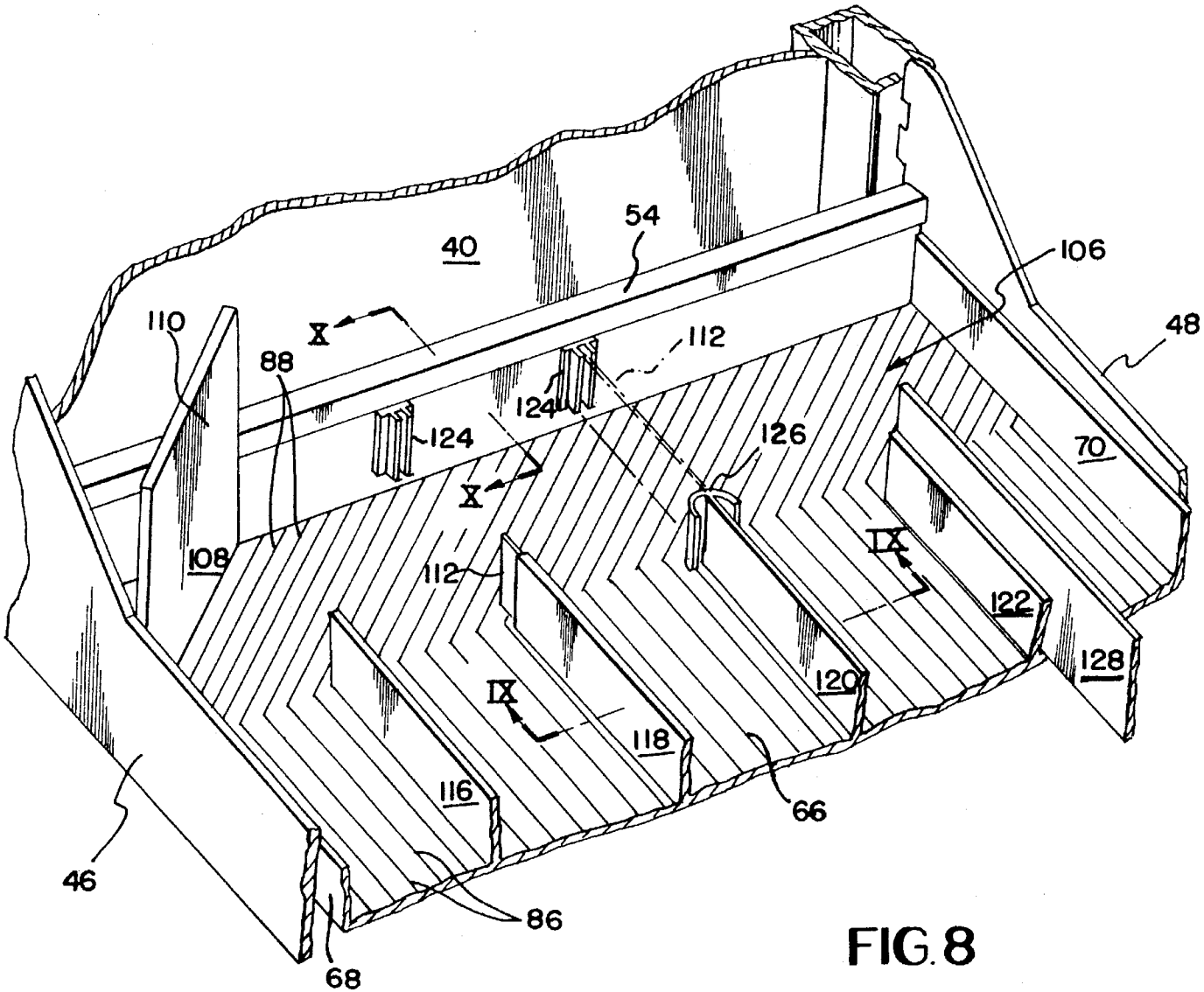
FIG. 8 is a fragmentary enlarged perspective view of a modified form of either one of the display shelf devices in FIG. 1.

When a number of bottles are dispensed and removed from the shelf, new bottles should be replenished. FIGS. 6–8 illustrates the way such replenishment is carried out. For the purpose of replenishing the shelf such as 42 with bottles, the track between the partition walls 68 and 72, i.e., the track associated with the guide means 84, is used as an inlet or loading port for bottles. More particularly, first, the bottles remaining in the inlet track are manually picked up and moved into other suitable tracks on the same or different shelf. New bottles B1–B5 are then loaded into the inlet track from the front edge 80 as shown in FIG. 6 and are then pushed backward along the shorter arrow in FIG. 6 against the guide means 84. The bottles B1–B5 are pressed against the guide means 84 one after another and are guided laterally along the front surface 90 into the diverting pathway. The oblique ribs 88 on the panel 66 also assist the bottles in moving laterally. Such lateral movement of the bottles is best shown by the position of the bottle B1 as depicted by the solid line in FIG. 6.

The bottles thus moved into the diverting pathway are then moved across the rear of the shelf and cascade down due to the gravity as any partially filled or empty track is reached. In FIG. 6, the bottle B1 slides down along the longer arrow into the second track, i.e., the track between the walls 72 and 74, and takes the position as depicted by the phantom line behind the old bottle B0 in the second track. The following bottles also slide down into the second track until the second track is filled as shown in FIG. 7 wherein the new bottles B1–B3 and the old bottle B0 are received in the second track.

After the second track is filled, the following bottles such as bottles B4 and B5 move along the pathway behind the bottle B3, pass the bottle B3 and cascade down into the third track, i.e., the track between the walls 74 and 76. This is best shown in FIG. 7 wherein the bottle B4 moves along the longer arrow into the position as indicated by the phantom line behind the two old bottles B0 in the third track. When the third track is filled with bottles, the following bottles such as B6 and B7 cascade down into the fourth track. In like manner, the tracks are filled with bottles one after another such that a track is filled prior to another track which is located remoter from the inlet track than the former track.

As has been described, the shelf according to the invention can be replenished with bottles such that newer bottles are placed behind older bottles. This allows the older bottles to be maintained at the front of the shelf even after the shelf has been replenished, which in turn allows the bottles to be removed/purchased in the sequence of date of manufacture.

Figure 9:
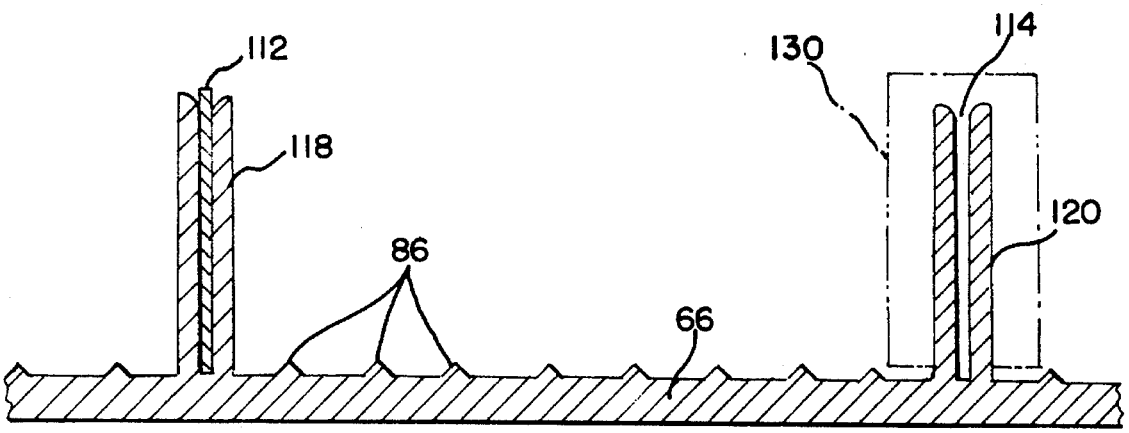
FIG. 9 is a view taken along the line IX—IX in FIG. 8.
Figure 10:
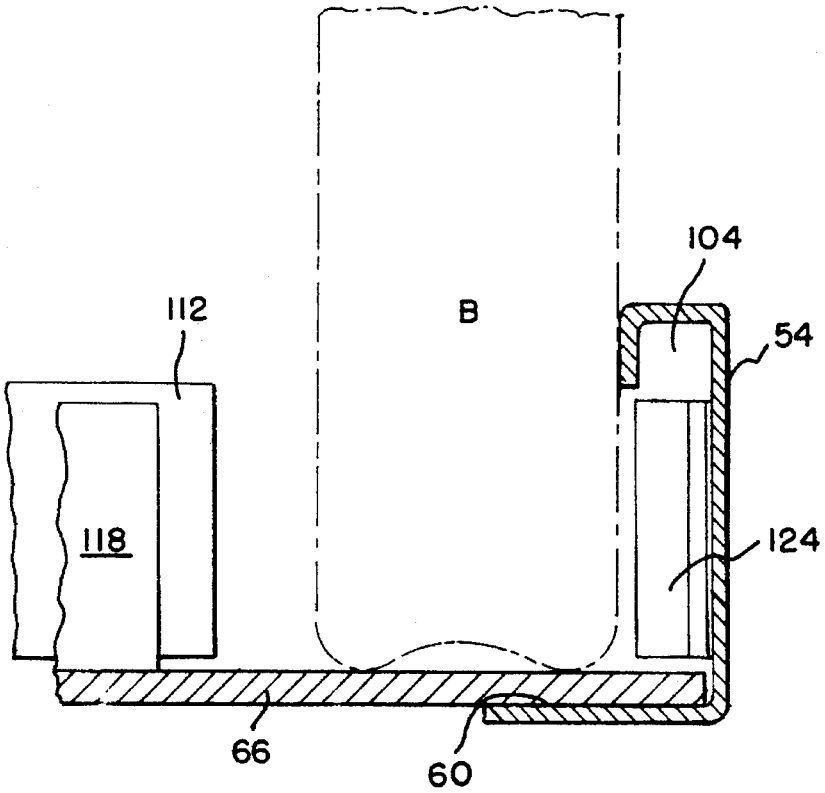
FIG. 10 is a view taken along the line X—X in FIG. 8.

FIGS. 8 to 10 shows a modified form of the shelf 42 or 44, in which portions identical in structure to those in FIGS. 1–7 are designated by like reference numerals and, accordingly, the description thereof will be omitted. In this modified shelf, the shelf unit 106 is provided with a guide member 108 having a flat guide surface 110. The guide member 108 extends from the panel 66 so that the guide surface define about a right angle with respect to the panel 66. This guide surface 110 extends parallel to the ribs 88 and defines an obtuse angle with respect to the ribs 86 as viewed from the top. The preferred angle between the guide surface 110 and the ribs 86 as viewed from the top is about 135 degrees.

The unit 106 is also provided with removable gate panels 112 which are removably received and frictionally retained in gaps 114 formed in the intermediate partition walls 116, 118, 120 and 122. These gate panels 112 are normally held in the retracted position as shown by the solid line in FIGS. 8 and 10 so as not to obstruct the pathway. However, when it is desired to restrict the number of the tracks into which replenished bottles may cascade down, one of the gate panels 112 is moved to the extended position as shown by the phantom line in FIG. 8 to extend between the associated partition wall and the rear element 54. For example, the gate panel 112 as depicted by the phantom line restricts the available intermediate tracks to the second and third tracks so that the fourth and fifth tracks are available for bottles of a different brand. Reference numeral 124 designates end receivers secured to the inside surface of the rear element 54. Each end receiver 124 receives and frictionally retains the rear end of the associated gate panel 112 when such a gate panel 112 is brought into the extended position. As best shown in FIG. 10, these end receivers 124 do not interfere with movement of the bottles B in the pathway because the receivers 124 are accommodated within the channel-shaped recess 104 in the rear element 54.

The gate panels 112 are merely frictionally retained in the gaps 114 and thus removable from the respective gaps 114.

This means that use of one of the panels 112 will satisfy the expected needs for the gate panels since such one gate panel can be relocated to any one of the intermediate walls 118, 120 and 122 as needed. Alternatively, the gate panels 112 may be pivotally connected to the rear ends of all the intermediate partition walls except the wall 116 so as to be upwardly and downwardly swingable between the extended and retracted positions.

Among the intermediate partition walls, the wall 120 is provided at its rear end with guide means 126 in the form of an arrow-shaped projection. When either one of the third and fourth tracks is used as an inlet track, the guide means 126 is contacted by replenished bottles and serves a similar function to the guide means 84 or 108 in guiding replenished bottles laterally into the neighboring track or tracks.

Reference numeral 128 denotes a height-changing panel 128 received and frictionally retained in the gap 114 of the partition panel 122. The panel 128 is of a height higher than the partition walls 68, 116, 118, 120, 122 and 70. Installation of more than one panel similar to such a panel 128 allows bottles of various heights to be dispensed by the shelf. A width-changing member such as denoted by reference 130 in FIG. 9 may also be used when it is desired to utilize the shelf for bottles of different diameters. The width-changing member 130, for example, has a U-shaped cross section and is dimensioned to receive any one of the intermediate partition walls in its center recess. When such a member 130 is disposed over one or more of the partition panels 68, 116, 118, 120, 122 and 70, the width(s) of the associated track(s) can be adjusted to different sizes.

Figure 11:
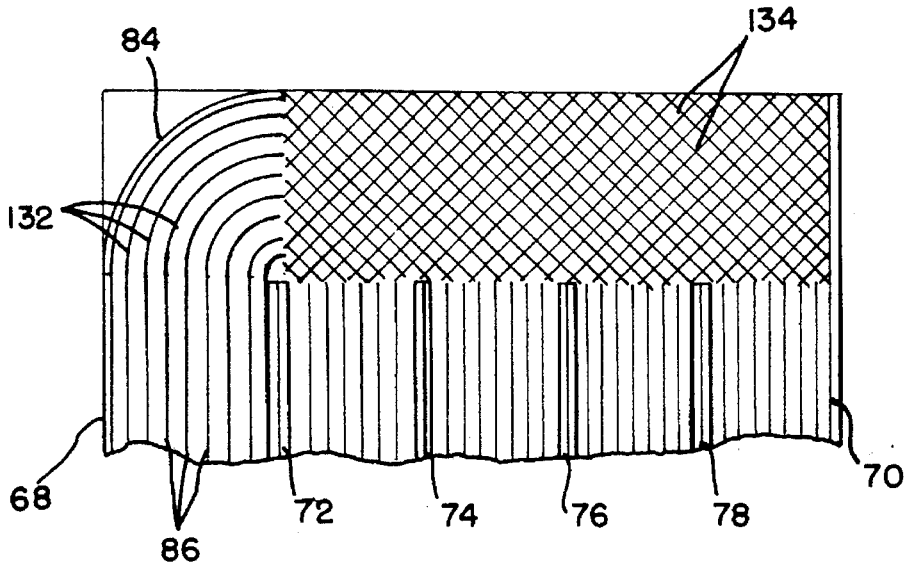
FIG. 11 is a fragmentary plan view of a modified form of the shelf unit in FIG. 3.

It will be recognized that many variations may be made to the foregoing within the scope of the present invention. For example, arcuate ribs 132 or cross ribs 134 as shown in FIG. 11 may be employed on the base panel 66 in place of the oblique ribs 88. The arcuate ribs 132 are equally spaced apart from each other. The ribs 132 extend rearward from the rear end of the inlet track and then curve toward the end partition wall 70 so as to be convex toward the guide member 84. Although the arcuate ribs 132 partially cover the floor of the pathway in FIG. 11, the entire floor of the pathway may be covered by the cross ribs 134. Also, the guide member 84 or 108 may be provided along one of its vertical edges with an engaging tab such as 136 as shown by the phantom line in FIG. 4 to stabilize itself. Such an engaging tab 136 is inserted into the gap between the end partition wall 68 and the side element 46.

It should be also recognized that two or more shelf units similar to the unit 64 or 106 may be disposed side by side on a large sized support frame. To make such an arrangement, it is preferred to use shelf units each having short end partition walls such as the walls 68, 72, 74, 76 and 78. By using such shelf units, the large sized shelf can be provided with a single continuous pathway.

It should be further recognized that a shelf unit similar to the unit 64 or 106 may be divided into a plurality of two-track segments by extending every other partition wall to the rear edge of the shelf unit. Alternatively, a shelf unit may be constructed to have only two tracks defined thereon, and a plurality of such two-track shelf units may be arranged side by side on a support frame.

Figure 12:
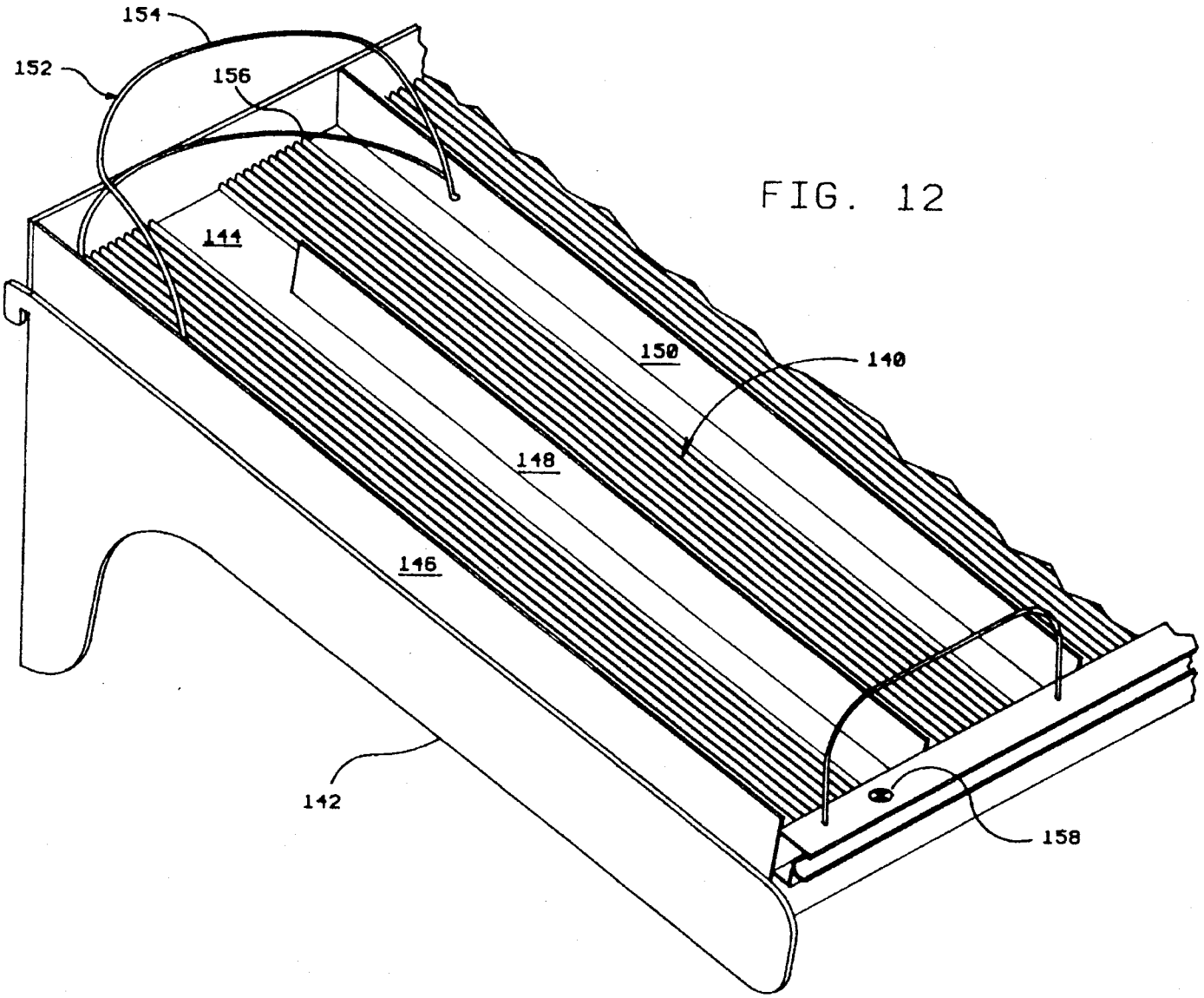
FIG. 12 is a fragmentary enlarged perspective view of another modified form of either one of the display shelf devices in FIG. 1.

An example of a shelf device having such two-track units/segments is shown in FIG. 12 wherein reference numeral 140 designates a two-track unit placed on a frame 142 similar to the one shown in FIG. 2. The unit 140 has three spaced parallel partition walls 146, 148 and 150 upstanding from a base panel 144. The track between the partition walls 146 and 148 and the track between the partition walls 148 and 150 are intercommunicated at their rear ends through a pathway. The medial partition wall 148 terminates at the position remote from the rear edge of the shelf unit, and the pathway is defined between the rear end of the medial partition wall 148 and a guide means 152 at the rear of the unit 140.

The guide means 152 is formed of a wirework consisting of upper and lower arcuate wire elements 154 and 156. Each wire element extends rearward from the end partition wall 146 and curves toward the end partition wall 150 and then forward to the rear end of the other track. By this means, the pathway is formed with an forwardly concavely arched outer perimeter defined by the wirework 152 so that bottles in either one of the tracks can be guided along the wirework 152 into the other track when moved backwards along the respective track. The reference numeral 158 denotes a marking which is used to indicate which one of the two tracks should be used as an inlet track.

The two-track unit 140 may be used either in a tilted condition or in a horizontal condition. In a tilted condition the wirework 152 can, of course, be replaced by a curved panel member such as at 84 or 98. In a horizontal condition, however, any guide member used with the unit 140 should extend between the end partition walls 146 and 150.

It should be recognized that the foregoing forms of the invention may also be applied to mechanical gravity feed shelves having belted tracks. Such mechanical shelves and tracks are disclosed, for example, in U.S. Pat. No. 4,239,099 which is hereby incorporated by reference.

It should be further recognized that the articles useful in the foregoing forms of the invention are not limited to bottles but they may be cans, cartons and other packages such as brick packs and potato chip bags, or the like.

Figure 13:
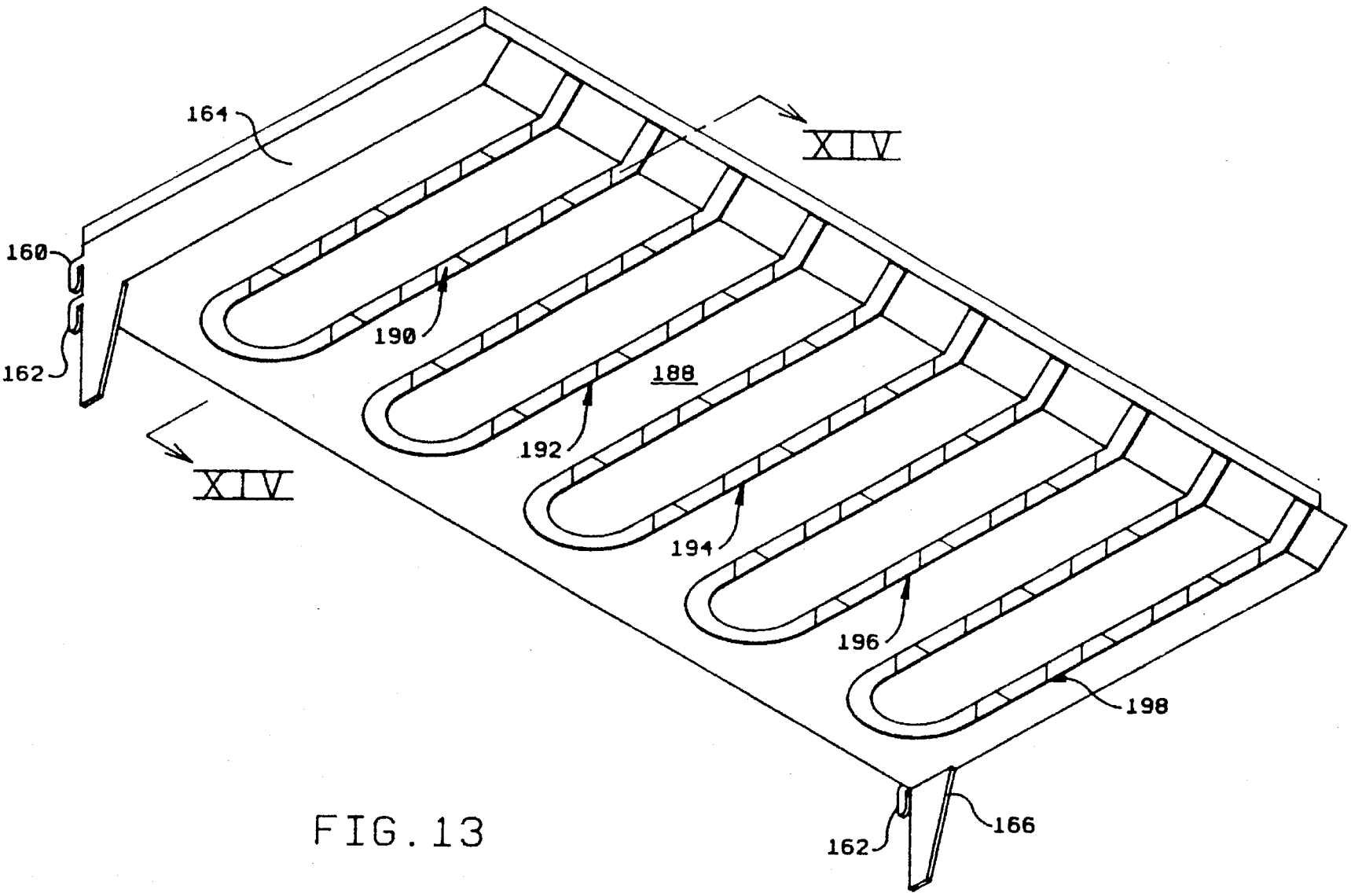
FIG. 13 is a perspective view of a suspension type bottle dispensing device according to the present invention.

FIGS. 13–17 illustrate a suspension type bottle dispensing device adapted to display PET bottles having outwardly projecting annular flanges at their necks. The shelf-like device shown in FIG. 13 is designed to be mounted on a vertical post used in a typical gondola rack such as shown in FIG. 1. To connect the device detachably to a vertical post such as 24 and 26 in FIG. 1, engaging tabs 160 and 162 on the side elements 164 and 166 cooperate with the slots in the posts. The side elements 164 and 166 are interconnected by three spaced parallel transverse elements, i.e., a front element 168, an intermediate element 170 and a rear element 172 (shown in FIG. 14).

Figure 15:
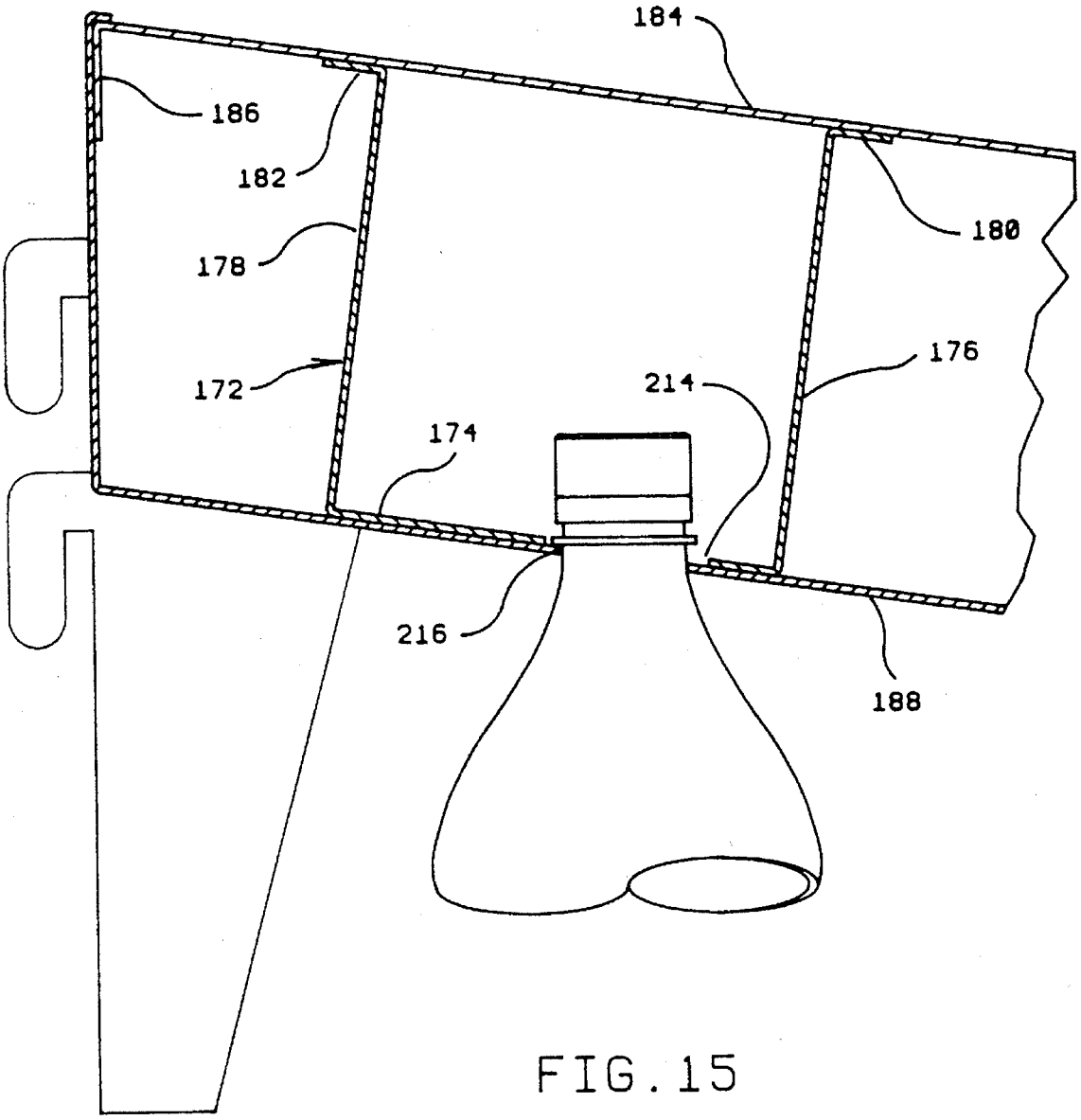
FIG. 15 is a view taken along the line XV—XV in FIG. 16.

As best shown in FIG. 15, each transverse element includes a bottom wall 174 and a pair of front and rear walls 176 and 178 joined to the bottom wall 174 to form a channel structure having a generally U-shaped cross section. The front and rear walls 176 and 178 are provided along their upper edges with upwardly facing flanges 180 and 182 which are joined to an upper panel 184. The front and rear edge portions of the upper panel 184 are folded down to form transversely extending flanges such as at 186 in FIG. 15. A lower panel 188 is joined along its front and rear edges to the upper panel 184. The lower panel 188 may be welded to or mechanically connected by any conventional means to the transverse flanges of the upper panel 184 as well as to the bottom wall 174 of each transverse element. Alternatively, the lower panel 188 may be integrally formed with the upper panel 184 and joined to the bottom walls 174.

Referring again to FIG. 13, the lower panel 188 is provided with a plurality of U-shaped slots 190, 192, 194, 196 and 198 arranged side by side. All the slots are virtually identical in structure, and thus description will hereinafter be made with respect to the slot 190 only.

Figure 16:
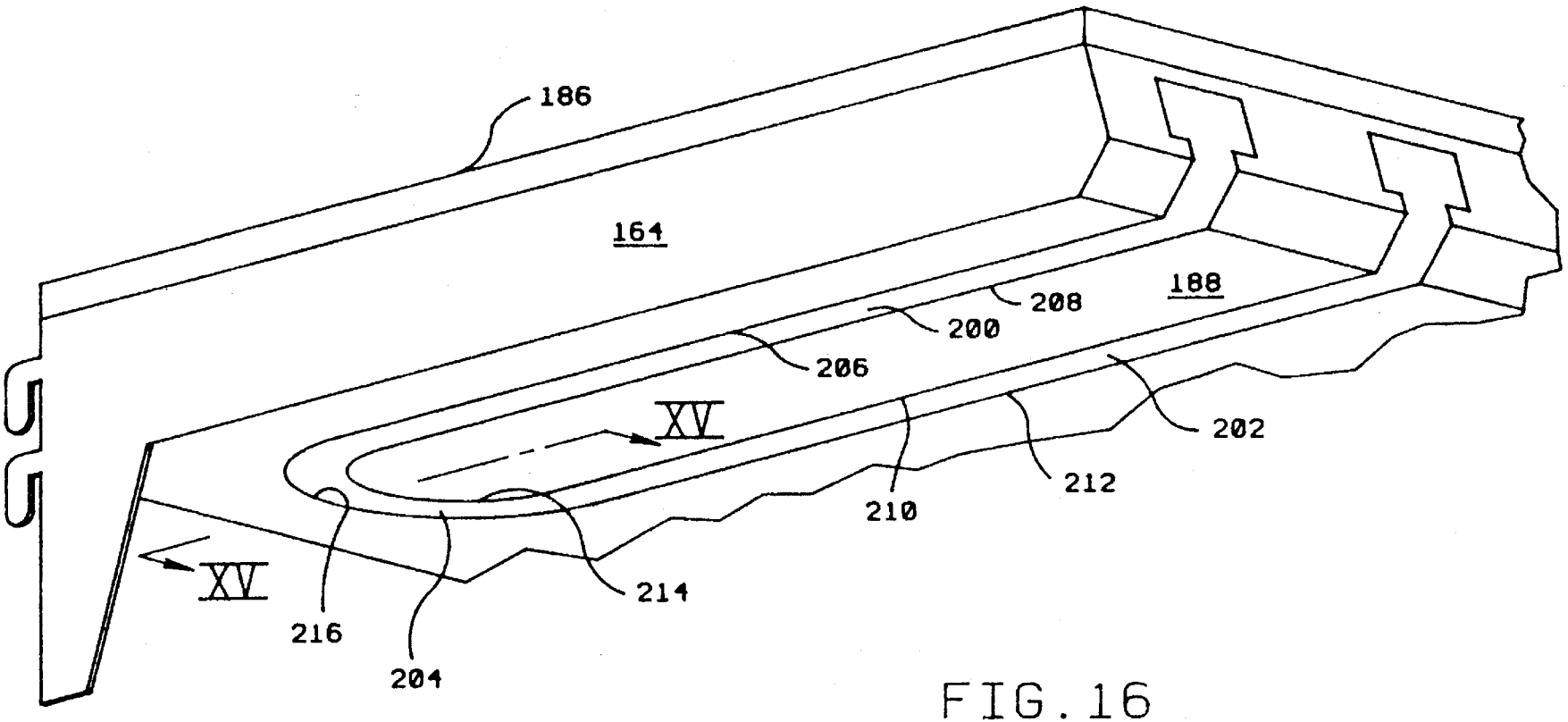
FIG. 16 is a fragmentary enlarged perspective view of the device in FIG. 13.

FIG. 16 illustrates the slot 190 in an enlarged condition wherein a pair of spaced parallel straight portions 200 and 202 are intercommunicated at their rear ends through an arcuate portion 204. The straight portions 200 and 202 will hereinafter be referred to as "tracks" whereas the arcuate portion 204 will be referred to as "pathway".

Figure 17:
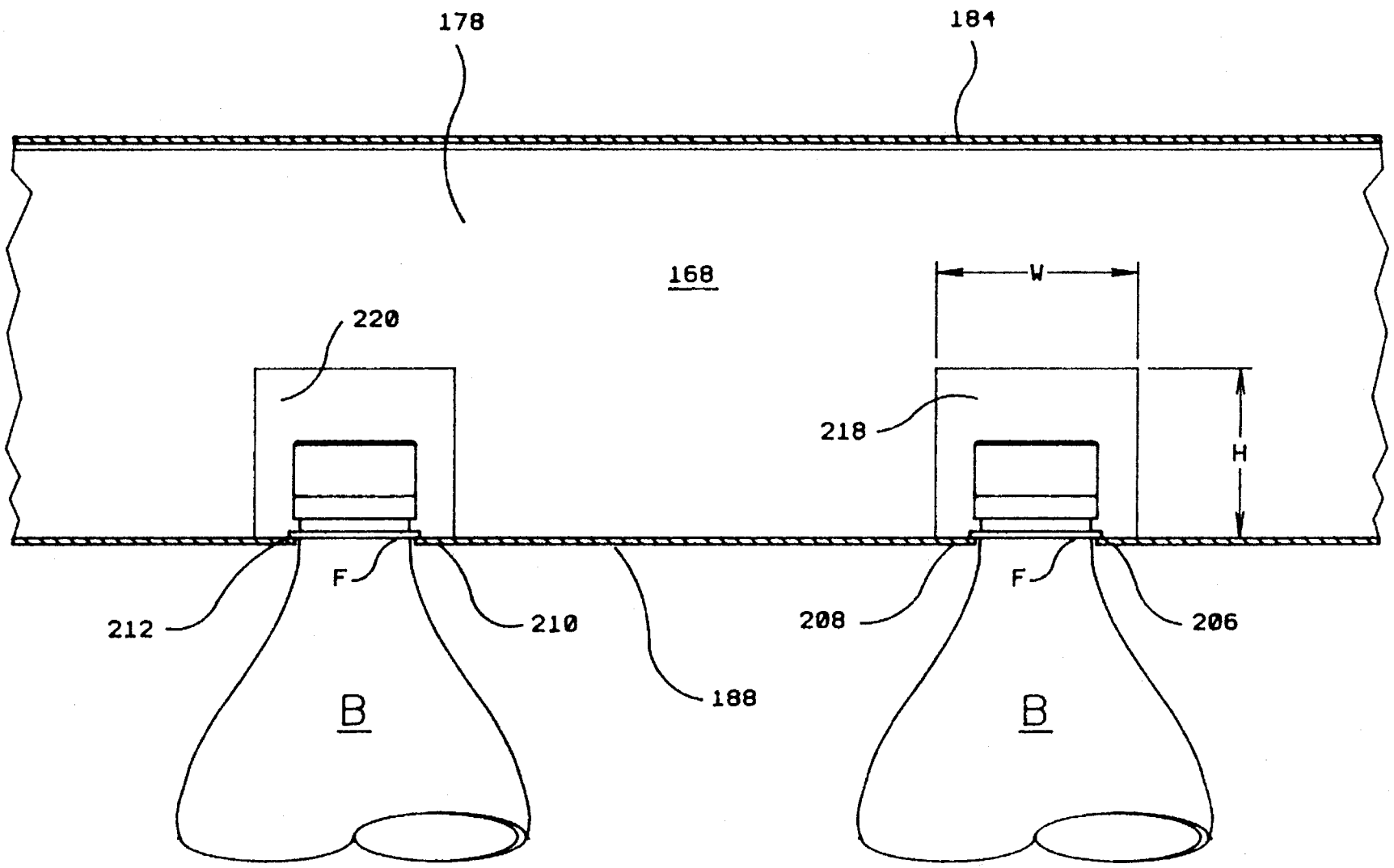
FIG. 17 is a view taken along the line XVII—XVII in FIG. 14.

As shown in FIGS. 16 and 17, the track 200 is defined between a pair of spaced parallel track rails 206 and 208 which are provided by the slot edges of the lower panel 188 along the track 200. Similarly, the track 202 is defined between a pair of spaced parallel track rails 210 and 212 which are provided by the slot edges of the lower panel 188 along the track 202. These track rails of each pair, as shown in FIG. 17, receive between them the necks of flanged bottles "B" such that the bottles are slidably engaged at the undersides of their neck flanges "F" with those rails and are thereby suspended by their neck flanges "F".

The pathway 204 is defined between a pair of inner and outer arcuate rails 214 and 216 as shown in FIG. 15. These arcuate rails 214 and 216 may have a common center of curvature so that the distance between the rails 214 and 216 is constant. The arcuate rails 214 and 216 are provided also by the slot edges of the lower panel 188 along the pathway 204. As shown in FIG. 15, the rails 214 and 216 also receive between them the necks of flanged bottles "B" in the same manner as the track rails so that the received bottles are suspended by their neck flanges "F".

Generally U-shaped cutouts such as at 218 and 220 in FIG. 17 are formed in each transverse element at immediately above the respective tracks and pathway. More specifically, each cutout is formed in the bottom wall 174 such that it extends transversely all the way across the bottom wall 174 and further extends into the opposite side walls 176 and 178. The height "H" and the width "W" of each cutout is such that the respective transverse element does not interfere with the bottle necks when bottles are moved along the slots.

As it is clear from the fact that all the rails 206, 208, 210, 212, 214 and 216 are provided by the portions of the lower panel 188, the track rails 208 and 210 are continuous with each other through the inner arcuate rail 214, and so are the track rails 206 and 212 through the outer arcuate rail 216. In particular, the outer rail 216 extends rearward from the rear end of the track rail 206 and curves toward the side element 166 and then toward the rear end of the track rail 212. By this means, the outer rail 216 provides an arched guide surface for bottles. When bottles are moved backwards along either one of the tracks 200 and 202, they are guided along the outer arcuate rail 216 into the other track 200 or 202 through the pathway 204. Accordingly, either track 200 or 202 can be used as an inlet track for encouraging bottle stock rotation.

Figure 14:
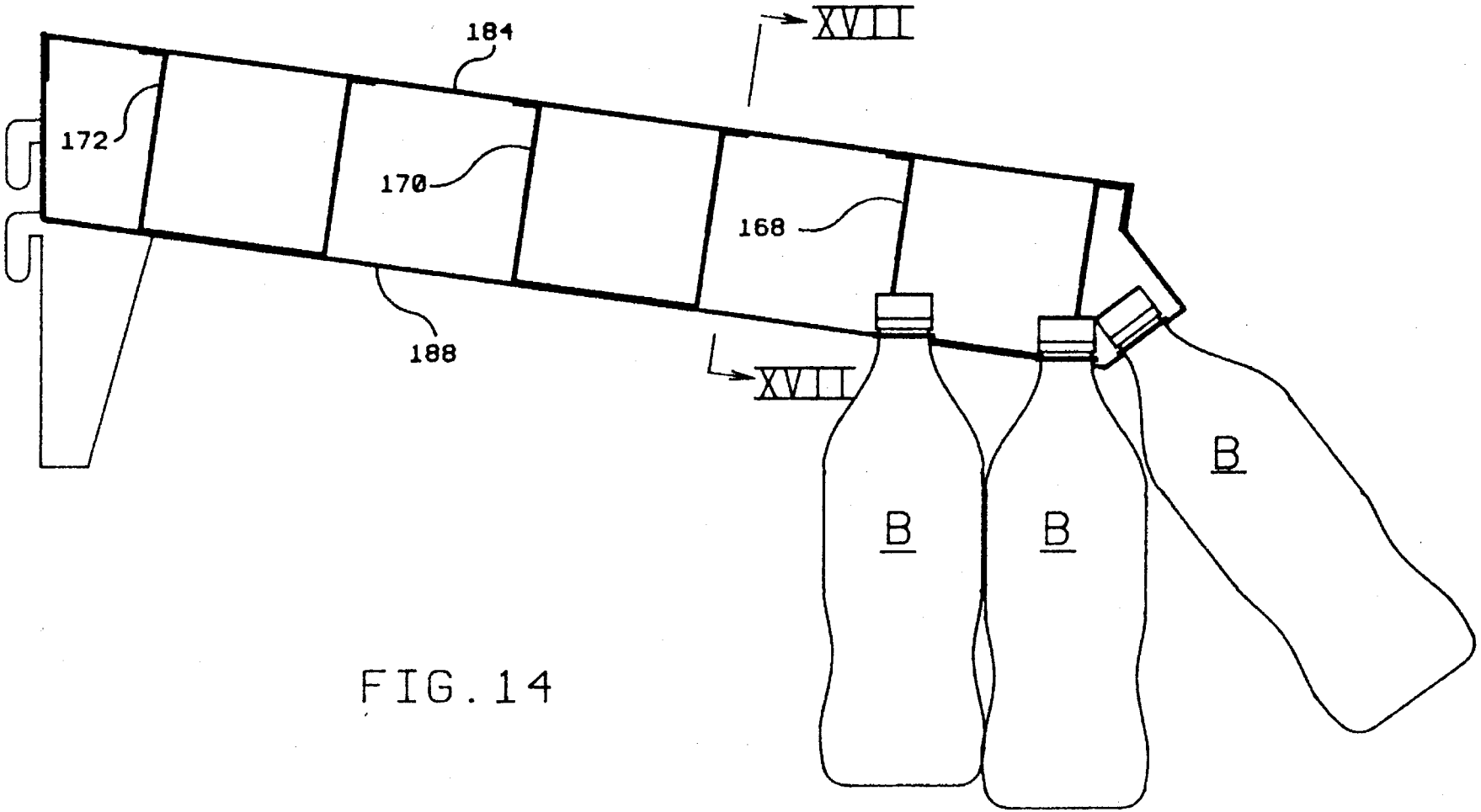
FIG. 14 is a view taken along the line XIV—XIV in FIG. 13, showing a few bottles hanging from the front portion of the track.

The front portion of the lower panel 188 is folded upwards as shown in FIGS. 13 and 14. This causes respective lengths of the track rails 206, 208, 210 and 212 adjacent to the front edge of the device to be upturned relative to the remainder of the track rails. This arrangement provides stop means for the leading bottles in each track. The details of such stop means are described, for example, in U.S. Pat. Nos. 4,318,485 and 4,401,221 which are hereby incorporated by reference.

Figure 18:
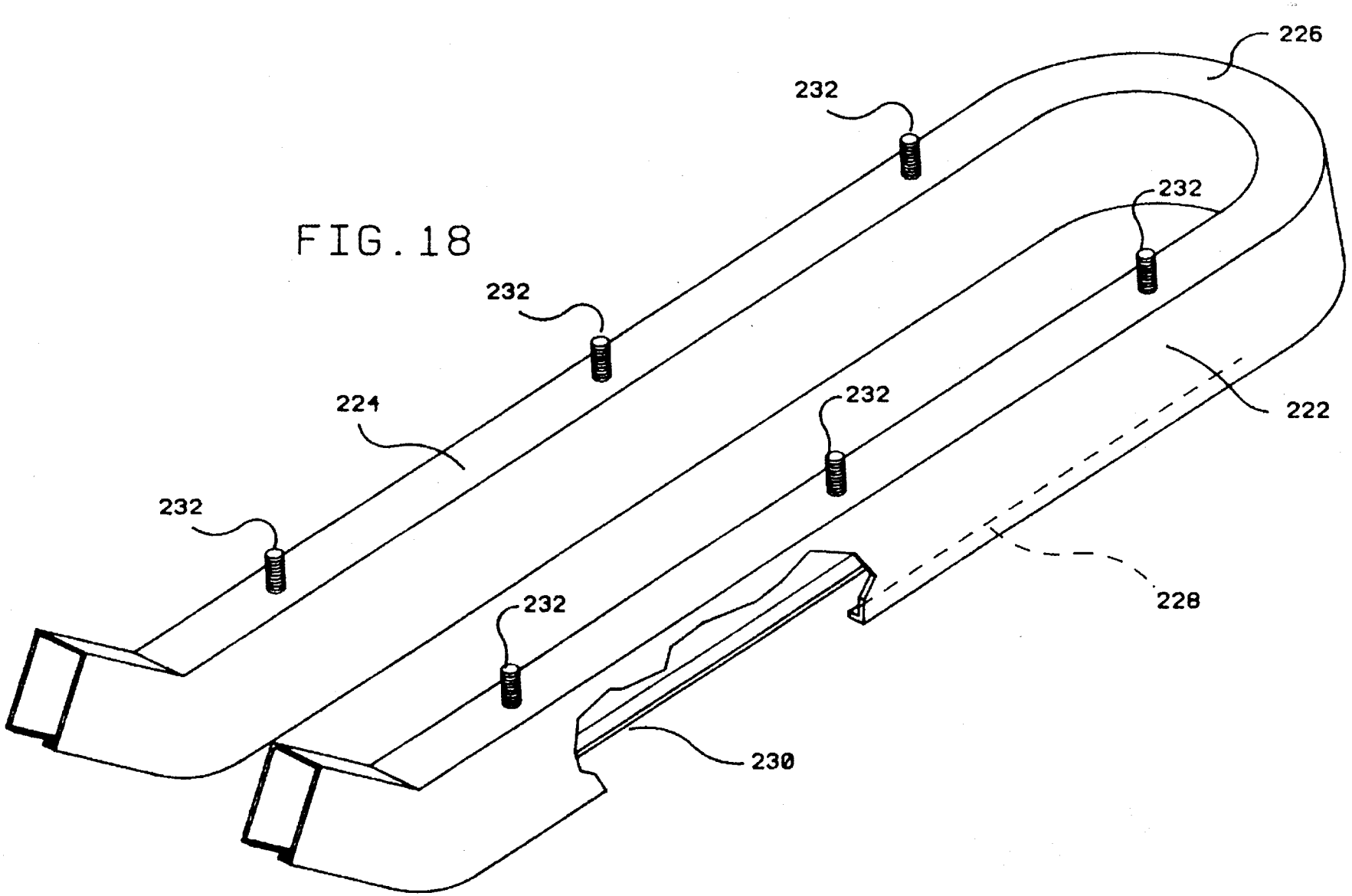
FIG. 18 is a perspective view of a modified form of the suspension type bottle dispensing device in FIG. 13.

FIG. 18 shows a modified form of the foregoing suspension type device. The shown unit is designed to be connected to the underside of the shelf-like device in FIG. 13 in place of the lower panel 188. The unit is formed of an elongate channel structure having an inverted U-shaped cross section and includes a pair of straight portions 222 and 224 connected at their rear ends with an arcuate portion 226. The channel structure is provided along the lower edges of its side walls with a pair of spaced rails 228 and 230. These rails 228 and 230 extend entirely along the structure and define therebetween tracks and a pathway for bottles. The tracks are defined along the straight portions 222 and 224 whereas the pathway is defined along the arcuate portion 226. Lengths of the straight portions 222 and 224 adjacent to their front ends are upturned to provide bottle stop means. The reference numeral 232 designates screws projecting upwards from the top wall of the structure to connect the unit to the transverse elements such as at 168, 170 and 172 in FIG. 14.

The foregoing suspension type devices may be formed preferably of metal. However, the devices may also be formed of plastic material such as polyvinyl chloride, polystyrene and the like. Alternatively, the devices may be metal-based and may be covered or coated along there rails with low friction material such as polytetrafluoroethylene, polystyrene having silicone or some other lubricant material dispersed therein, and the like. The rail cover formed of such low friction material may be of a C-shaped cross section to receive therein the associated track rail. Otherwise, such a cover may be a lubrous tape.

It will be readily recognized that the foregoing suspension type devices are the two-track device, and therefore they may be used either in a tilted condition or in a horizontal condition. When tilted, the angle of tilt from the horizontal may be about 1 to 20 degrees, preferably about 2 to 18 degrees and most preferably about 8 to 10 degrees.

It will be also recognized that the device in FIG. 13 may be provided with a separate rectangular support frame instead of the side elements 164 and 166. More particularly, such a device without the side elements may be removably received in and supported by the rectangular frame which has engaging tabs such as shown at 160 and 162. Such an arrangement will facilitates assembly of the display stand formed therefrom.

What is claimed is:

1. A display device comprising an article dispenser means having a front edge and a rear edge and adapted to support articles, said dispenser means comprising:

means for defining a plurality of parallel tracks, each track extending from said front edge toward said rear edge to receive a row of articles for movement along said each track;

means for defining a diverting pathway extending substantially transversely of said tracks so that said tracks are intercommunicated at rear ends thereof through said pathway, said pathway being dimensioned to receive articles for movement therealong and being arranged such that articles are allowed to be transferred from said pathway to said each track and vice versa; and guide means disposed adjacent to said rear end of one of said tracks and having a guide surface such that when moved backwards along said one track, articles in said one track are brought into contact one after another with said guide surface and guided laterally of said one track along said guide surface into said pathway to be transferred to the other track or tracks through said pathway, said display device further comprising support means for supporting said dispenser means in a tilted fashion such that said dispenser means is inclined downwardly toward said front edge thereof whereby articles when received in said each track are allowed to gravity feed one after another to said front edge as leading articles in said each track successively are removed from said each track and whereby articles when received in said pathway are allowed to gravity feed from said pathway into said tracks.

2. The display device according to claim 1, wherein said dispenser means comprises a shelf unit on which articles are placed to be displayed, said shelf unit providing said front and rear edges, and said track-defining means comprises a floor for slidably supporting articles at bottoms thereof and a plurality of spaced parallel partition walls upstanding from said floor and extending along said tracks so that said each track is defined by said floor and a pair of adjacent ones of said partition walls.

3. The display device according to claim 2, wherein said shelf unit has a pair of opposite side edges which are defined by end ones of said partition walls, and said partition walls except for said end partition walls are intermediate partition walls extending from said front edge of said shelf unit toward said rear edge and terminate in respective rear ends thereof which are located at positions remote from said rear edge of said shelf unit.

4. The display device according to claim 3, wherein at least one of said end partition walls extending all the way between said front and rear edges of said shelf unit.

5. The display device according to claim 3, wherein the distance between said rear edge of said shelf unit and said rear ends of said intermediate partition walls is no less than a transverse size of each of articles to be loaded into said tracks.

6. The display device according to claim 5, wherein said shelf unit is to be loaded with bottles and said distance is no less than the diameter of each of said bottles.

7. The display device according to claim 2, wherein said shelf unit has opposite side edges extending between said front and rear edges, said guide means is located between said rear end of said one track and said rear edge of said shelf unit, and said diverting pathway extends between said guide means and one of said side edges of said shelf unit.

8. The display device according to claim 7, wherein said pathway-defining means comprises a floor for slidably supporting articles, said floor of said pathway-defining means being continuous with and disposed in the plane of said floor of said track-defining means.

9. The display device according to claim 8, wherein said shelf unit further comprises locking means for detachably connecting said guide means to said floor of said pathway-defining means.

10. The display device according to claim 9, wherein said locking means comprises a locking aperture formed in said floor of said pathway-defining means and a locking tab formed on said guide means and dimensioned to engage said locking aperture.

11. The display device according to claim 8, wherein said guide means is formed integrally with said floor of said pathway-defining means so as to extend from said floor of said pathway-defining means.

12. The display device according to claim 8, wherein said guide surface defines about a right angle with respect to said floor of said pathway-defining means, said guide surface extending rearward from said rear end of said one track and curving toward said one side edge of said shelf unit so that said guide surface is concave toward said pathway.

13. The display device according to claim 12, wherein said guide surface is configured as a part of a cylindrical surface.

14. The display device according to claim 8, wherein said guide surface defines about a right angle with respect to said floor of said pathway-defining means and is disposed in angular relationship with an imaginary line parallel to the length of said tracks.

15. The display device according to claim 14, wherein said guide surface defines an obtuse angle with respect to said imaginary line.

16. The display device according to claim 2, wherein said pathway-defining means comprises a floor for slidably supporting articles, said floor of said pathway-defining means being continuous with and disposed in the plane of said floor of said track-defining means, said floor of said pathway-defining means being provided with a plurality of spaced parallel ribs disposed in angular relationship with an imaginary line parallel to the length of said tracks.

17. The display device according to claim 16, wherein said ribs define an obtuse angle with respect to said imaginary line.

18. The display device according to claim 2, wherein said shelf unit has opposite side edges extending between said front and rear edges, said pathway-defining means comprises a floor continuous with and disposed in the plane of said floor of said track-defining means, and said floor of said pathway-defining means is provided with a plurality of spaced arcuate ribs extending rearward from said rear end of said one track and curving toward one of said side edges such that said arcuate ribs are convex toward said guide means.

19. The display device according to claim 2, wherein said guide means comprises a projection disposed on one of said adjacent partition walls of said one track near said rear end thereof and projecting laterally from said one adjacent partition walls.

20. The display device according to claim 2, further comprising a gate panel extending between said rear end of intermediate one of said partition walls and said rear edge of said shelf unit so as to limit the length of said pathway to a length between said guide means and said gate panel.

21. The display device according to claim 20, said gate panel comprises means for removably connecting said gate panel to said intermediate partition wall.

22. The display device according to claim 2, further comprising a gate panel connected to intermediate one of said partition walls for movement between an extended position where said gate panel extends between said rear end of said intermediate partition wall and said rear edge of said shelf unit and a retracted position where a rear end of said gate panel is remote from said rear edge.

23. The display device according to claim 2, further comprising a height-changing panel removably connected to at least one of said partition walls to substantially increase the height of said one partition wall.

24. The display device according to claim 2, further comprising a width-changing panel removably connected to at least one of said partition walls to substantially reduce the width of at least one of said tracks adjacent to said one partition wall.

25. The display device according to claim 1, wherein said dispenser means has a pair of opposite side edges extending between said front and rear edges, said track-defining means defines a pair of said tracks, and said guide surface extends rearward from said rear end of said one track and curves toward one of said side edges and then forward to said rear end of said other track such that said pathway has an arched outer perimeter defined by said guide surface whereby when moved backwards along said one track, articles in said one track are guided along said guide surface into said other track through said pathway.

26. The display device according to claim 25, wherein said dispenser means comprises a shelf unit on which articles are placed to be displayed, said shelf unit providing said front and rear edges, said track-defining means comprises a floor for slidably supporting articles at bottoms thereof and three spaced parallel partition walls upstanding from said floor and extending along said tracks so that said each track is defined by said floor and a pair of adjacent ones of said partition walls, medial one of said partition walls extending from said front edge toward said rear edge and terminating in a rear end thereof which is located at a position remote from said rear edge, and said pathway is defined between said guide surface and said rear end of said medial partition wall.

27. The display device according to claim 26, wherein said opposite side edges are defined by end ones of said partition walls, and said guide surface is extending between said end partition walls.

28. A display device comprising an article dispenser means having a front edge and a rear edge and adapted to support articles, said dispenser means comprising:

means for defining a plurality of parallel tracks, each track extending from said front edge toward said rear edge to receive a row of articles for movement along said each track;

means for defining a diverting pathway extending substantially transversely of said tracks so that said tracks are intercommunicated at rear ends thereof through said pathway, said pathway being dimensioned to receive articles for movement therealong and being arranged such that articles are allowed to be transferred from said pathway to said each track and vice versa; and guide means disposed adjacent to said rear end of one of said tracks and having a guide surface such that when moved backwards along said one track, articles in said one track are brought into contact one after another with said guide surface and guided laterally of said one track along said guide surface into said pathway to be transferred to the other track or tracks through said pathway, wherein said dispenser means has a pair of opposite side edges extending between said front and rear edges, said track-defining means defines a pair of said tracks, and said guide surface extends rearward from said rear end of said one track and curves toward one of said side edges and then forward to said rear end of said other track such that said pathway has an arched outer perimeter defined by said guide surface whereby when moved backwards along said one track, articles in said one track are guided along said guide surface into said other track through said pathway, wherein said dispenser means comprises a bottle suspension unit for supporting flanged bottles such that said bottles are suspended by neck flanges thereof, and said track-defining means comprises two pairs of substantially parallel track rails extending along said tracks, each of said pairs defining respective one of said tracks, said rails of said each pair being spaced apart to receive therebetween necks of said bottles such that said bottles are slidably engaged at undersides of said neck flanges with said rails of said each pair, said pathway-defining means comprises a pair of inner and outer arcuate rails spaced apart to receive therebetween said necks of said bottles such that said bottles are slidably engaged at said undersides of said neck flanges with said arcuate rails, and said guide surface is provided by said outer arcuate rail.

29. The display device according to claim 28, wherein said inner arcuate rail interconnects rear ends of intermediate ones of said track rails such that said intermediate track rails are continuous with each other through said inner arcuate rail, and said outer arcuate rail interconnects end ones of said track rails such that said end track rails are continuous with each other through said outer arcuate rail.

30. A gravity feed display shelf comprising a shelf unit having a front edge and a rear edge and support means for supporting said shelf unit so that said shelf unit is inclined downwardly toward said front edge thereof, said shelf unit comprising:

means for defining a plurality of parallel tracks, each track extending from said front edge toward said rear edge to receive a row of articles for movement along said each track whereby articles when received in said each track are allowed to gravity feed one after another to said front edge as leading articles in said each track successively are removed from said each track;

means for defining a diverting pathway extending transversely along said rear edge of said shelf unit so that said tracks are intercommunicated at rear ends thereof through said pathway, said pathway being dimensioned to receive articles for movement therealong and being arranged such that articles are allowed to be transferred from said pathway to said each track and vice versa whereby articles when received in said pathway are allowed to be gravity fed into said tracks; and guide means disposed adjacent to said rear end of one of said tracks and having a guide surface such that when forcibly moved backwards along said one track, articles in said one track are brought into contact one after another with said guide surface and guided laterally of said one track along said guide surface into said pathway to gravity feed from said pathway into at least one of the other ones of said tracks.

* * * * *